US006358096B1

(12) United States Patent
Beckman

(10) Patent No.: US 6,358,096 B1
(45) Date of Patent: Mar. 19, 2002

(54) MULTIPLE SOURCE POWER ADAPTER FOR OUTPUT POWER CONTROL

(75) Inventor: Jerry L. Beckman, Elk Point, SD (US)

(73) Assignee: Gateway, Inc., North Sioux City, SD (US)

( * ) Notice: Subject to any disclaimer, the term of this patent is extended or adjusted under 35 U.S.C. 154(b) by 0 days.

(21) Appl. No.: 09/751,578

(22) Filed: Dec. 29, 2000

(51) Int. Cl.[7] ..... H01R 33/94
(52) U.S. Cl. ..... 439/638; 439/956; 439/507
(58) Field of Search ..... 439/188, 353, 439/489, 507, 490, 509, 638, 955, 956; 307/116, 125, 140

(56) References Cited

U.S. PATENT DOCUMENTS 3,833,821 A * 9/1974 Weaver
4,053,788 A * 10/1977 Robie ..... 307/11
5,181,858 A * 1/1993 Matz et al. ..... 439/188
5,369,352 A * 11/1994 Toepfer et al. ..... 320/56

OTHER PUBLICATIONS

National Semiconductor Adapter Interface Circuit–AIC–IC Optimizes Safety and Power Control Functions for Notebook Computers,[on–line], Aug. 28, 2000, [retrieved on Sep. 15, 2000], retrieved from Business Wire, Santa Clara, CA Internet , <URL: http://access.nearac.com/WNDABASM>.

Port, Inc. Introduced Universal Auto/Air Adapter and Power Tips. [on–line], Apr. 12, 2000 [retrieved on Sep. 15, 2000] retrieved from PR Newswire, Internet: <URL: http://access.nearac.com/WNDABASM>.

Cynthia Bournellis, Bernard McAleer, Gateway 2000 Powerxtender Adapter [on–line][retrieved on Sep. 15, 2000] retrieved from Electronic News Internet: <URL: http://access.nearac.com/WNDABASM>.

Gateway 2000 Announces Airplane/Auto Power Adapter for Portables [on–line], Aug. 25, 1997 [retrieved on Sep. 15, 2000], retrieved from Newswire pp 08251423, Internet: <URL: http://access.nearac.com/WNDABASM>.

Connecting Abroad (traveling with a laptop) [on–line], [retrieved on Sep. 15, 2000] retrieved from Industry Week, vol. V247, No. n13, p. 53(1)., Internet: <URL: http://access.nearac.com/WNDABASM>.

Transmonde Technologies Announces New PowerXtender DC Airplane and Auto Adapter; DC Adapter Accessory Frees Up Battery in the Air and on the Road. [on–line] Jul. 7, 1997 [retrieved on Sep. 15, 1997], retrieved from Business Wire pp. 07071034, Internet: <URL: http://access.nearac.com/WNDABASM>.

Targus.com [on–line], May 30, 2001, [retrieved Sep. 19, 2000] Internet: <URL: www.targus.com>.

SAS Corporate Communications [on–line] [retrieved on Sep. 19, 2000] Internet: <URL www.scandinavian.net/company/newsfacts/press>.

PowerXtender Airplane & Auto Adapters [on–line] May 30, 2001 [retrieved Sep. 15, 2000], Internet: <URL www.powerxtender.com/products/dcAdapters.html>.

* cited by examiner

*Primary Examiner*—Khiem Nguyen
(74) *Attorney, Agent, or Firm*—Lyon & Lyon LLP

(57) ABSTRACT

A power adapter provides electrical power from multiple power sources. The power adapter includes first and second plugs adapted to be electrically coupled to first and second power sources, respectively. The power adapter is configured to provide a first power output from the first power source (e.g., airline power socket), and a second power output from the second power source (e.g., cigarette lighter socket), to the electronic device, depending on which power source to which the power adapter is coupled. The power adapter may also limit the first power output from the first power source to a predetermined maximum.

7 Claims, 2 Drawing Sheets

MULTIPLE SOURCE POWER ADAPTER FOR OUTPUT POWER CONTROL

FIELD OF THE INVENTION

The present invention relates generally to power adapters for portable electronic devices, and more particularly, to power adapters for providing power to portable electronic devices from multiple types of power sources.

BACKGROUND OF THE INVENTION

Today, people are highly mobile and require that their electronic tools with which they conduct their business be likewise mobile. Part of meeting that requirement is to provide portable electronic devices, such as cellular phones and laptop computers, with the power those devices need. Portable devices are usually equipped with rechargeable batteries, but even the most expensive and heavy batteries are rarely sufficient to deliver electrical power over a significant time period. These batteries need to be recharged periodically from various power sources, sometimes on the road.

Accordingly, portable devices are often equipped with power adapters for charging their batteries. The most common of these adapters plug directly into a wall outlet, or socket. Some adapters are designed to plug into the power outlet, more commonly known as the cigarette lighter socket with which most automobiles—and some boats and other vehicles—are equipped. Still further, some airlines are equipping their passenger airplanes with power sockets for charging and powering portable electronic devices. Primex Aerospace of St. Petersburg, Florida has developed what has become the standard in airline power sources, a system it calls the EmPower™ system. For added convenience, many manufacturers have produced power adapters with multiple plugs for connecting to multiple types of power sources. Notably, auto-air power adapters include one plug for connecting to an airline socket and another plug for connecting to a cigarette lighter socket, where the former plug is inserted into the latter plug when the adapter is connected to a cigarette lighter socket.

Existing auto-air power adapters need to provide portable electronic devices, such as laptop computers, with increasing power requirements. For airline power sources, a standard has been established that mandates a 5-amp circuit breaker for a 15-volt power socket, resulting in a maximum power delivery of 75 watts before the airline circuit breaker is tripped. Taking the efficiency of the power adapter into account (typically, about 90%), this results in an effective power output of slightly less than 70 watts to the portable device. However, for optimum performance, many notebook computers today require power levels that exceed 70 watts. While an airline power socket cannot deliver that preferred power output level, a cigarette lighter socket in an automobile or other vehicle can deliver such a power output level.

SUMMARY OF THE INVENTION

Accordingly, a power adapter is herein described for providing power from multiple power sources. The adapter is configured to supply distinct levels of power outputs depending on which power source to which the adapter is connected. Power outputs from various sources can thus be configured to meet the design requirements and limitations of various power sources.

In accordance with a preferred embodiment of the present invention, a power adapter provides electrical power from multiple power sources. The power adapter includes first and second plugs adapted to be electrically coupled to first and second power sources, respectively. The power adapter is configured to provide a first power output from the first power source, and a second power output from the second power source, to the electronic device, depending on which power source to which the power adapter is coupled.

In one aspect of a particular embodiment of the present invention, the first power source may be an airline power socket and the second power source may be a cigarette light socket. In another aspect of a particular embodiment, the power adapter may limit the first power output from the first power source to a predetermined maximum.

Other aspects and features of the present invention will become apparent from consideration of the following description taken in conjunction with the accompanying drawings.

BRIEF DESCRIPTION OF THE DRAWINGS

Preferred embodiments are illustrated by way of example, and not by way of limitation, in the figures of the accompanying drawings, in which like reference numerals refer to like components, and in which.

DETAILED DESCRIPTION OF THE PREFERRED EMBODIMENTS

Figure 1:
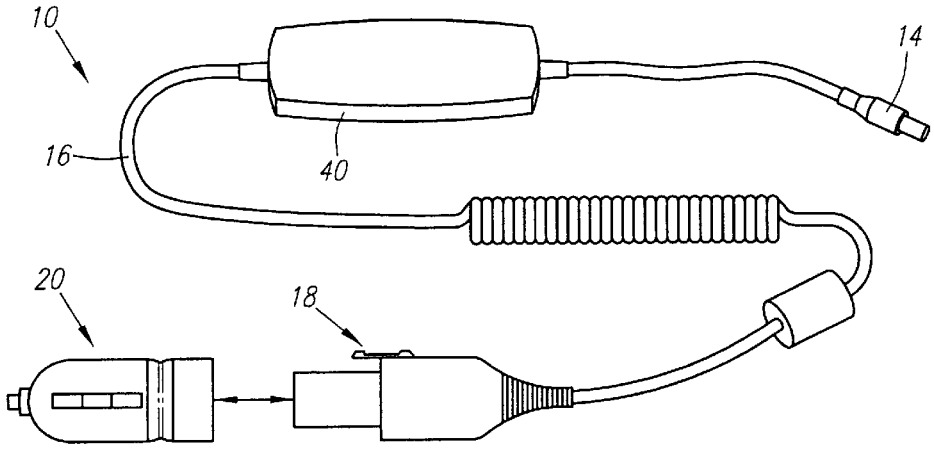
FIG. 1 is a power adapter according to a preferred embodiment.

An exemplary dual source power adapter 10 is shown in FIG. 1. The adapter 10 is configured to provide electrical power from one of multiple, distinct power sources to a portable electronic device 12 (shown in FIG. 5). The portable electronic device 12 may be a laptop computer, a cell phone, or any other portable electronic device for which it is desired to provide power from multiple, distinct power sources. The adapter 10 is configured to electrically couple to the device 12, thereby providing it with electrical power. The adapter 10 includes a plug for connecting to the device 12, the design of which is dictated by the device 12. The adapter 10 may further be compatible with several devices (such as different brands of computers or cell phones) by providing several device plugs, each configured to connect to a distinct type of device.

According to a preferred embodiment, the adapter 10 comprises a device plug 14 for connecting to the device 12. The plug 14 is attached at one end of a standard power cord 16, which is designed to meet the power requirements of the device 12. The adapter 10 further comprises a first plug 18 and a second plug 20. The first and second plugs 18 and 20 are each adapted to electrically couple with first and second power sources, respectively, by plugging into sockets of the respective power sources.

In accordance with a preferred embodiment, the first plug 18 is attached to an end of the cord 16 opposite the device plug 14. The second plug 20 is adapted to detachably receive the first plug 18 and electrically couple thereto. One end of the second plug 20 is configured similarly to the socket of the first power source so that it can receive the first plug 18. The other end of the second plug 20 is adapted to be received by the socket of the second power source.

Figure 2:
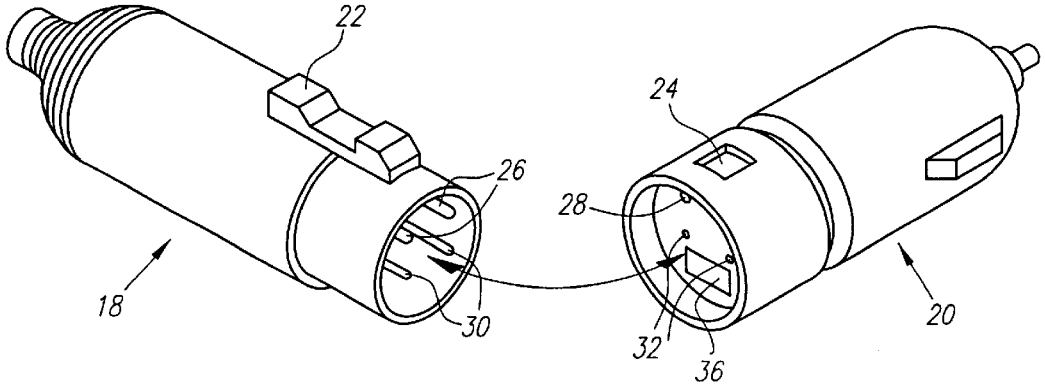
FIG. 2 is an unassembled view of first and second plugs of the power adapter illustrated in FIG. 1.
Figure 3:
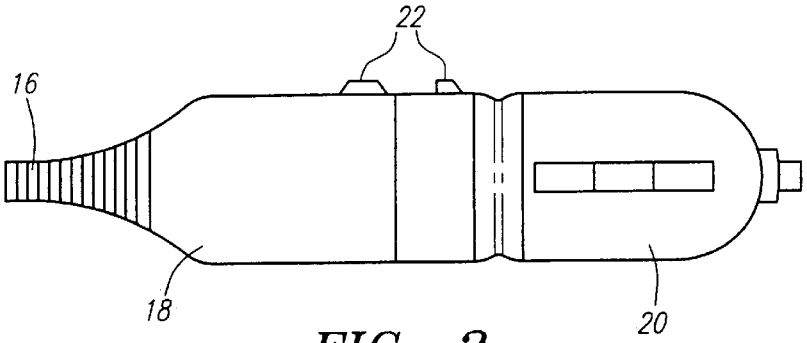
FIG. 3 is an assembled side view of the first and second plugs of the power adapter shown in FIGS. 1 and 2.
Figure 4:
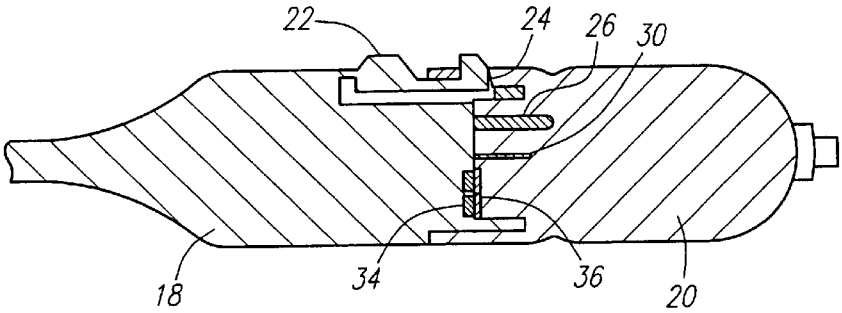
FIG. 4 is a cross sectional side view of the first and second plugs of the power adapter shown in FIGS. 1–3.

Preferably, the first and second plugs 18 and 20 include a releasable fastening mechanism. An exemplary fastening mechanism is shown in FIGS. 2–4, in which the first plug 18 includes a depressible latch 22. The latch 22 is configured to mate with a corresponding recess 24 in the second plug 20, thereby fastening the first and second plugs 18 and 20 together. When the first and second plugs 18 and 20 are fastened together, the latch 22 snaps into the recess 24, as shown in FIGS. 3 and 4. In this state, the latch 22 and recess 24 operably couple and prevent the first and second plugs 18 and 20 from being separated. The latch 22 is preferably made of a resilient material, or is otherwise resiliently fixed to the first plug 18, so that the latch 22 may be depressed by applying a force to the latch 22 towards the first plug 18. When such a force is applied, the latch 22 is freed from the recess 24 so that the first and second plugs 18 and 20 may be separated, as shown in FIG. 2. It can be appreciated by persons skilled in the art that a variety of known fastening mechanisms may be provided, including a frictional fit between the first and second plugs 18 and 20.

Referring to FIG. 2, the first plug 18 includes a first pair of leads 26 that fit into an associated first pair of ports 28 in the second plug 20. This first pair of leads 26 couples the second plug 20 to the first plug 18. The leads 26 thus carry electrical power from the second power source to the adapter 10.

In accordance with one aspect of a preferred embodiment, the first power source is capable of restricting its power output to a level below a maximum power capability of the adapter 10. For example, the first power source may be an in-seat power system for an airplane, such as the EmPower™ system developed by Primex Technologies of St. Petersburg, Fla. In accordance with another aspect of a preferred embodiment, the second power source is capable of providing its power output to a level at about a maximum power capability of the adapter 10. For example, the second power source may be a cigarette plug adapter, such as those found in most automobiles, boats, and many other vehicles. The adapter 10 having such first and second plugs 18 and 20, sometimes called an auto-air adapter, provides flexible power capabilities for users of portable electronic devices 12.

In the case where the first plug 18 is adapted to fit into an airline power socket, a second pair of leads 30 may be included on the first plug 18. These leads 30 are used for a special purpose according to the standards developed for airline power sockets. To accommodate these leads 30, corresponding holes 32 are provided on the second plug 20 so that the first and second plugs 18 and 20 can fit together, but the holes 32 provide no electrical connection because the leads 30 are only used when the adapter 10 is plugged into an airline power socket.

As stated, the power adapter 10 presently described is designed to provide power from at least two distinct power sources. As these power sources are distinct, the desired power output—defined as the electrical power drawn from the power source—may likewise be distinct. For example, in the case where the adapter 10 has one plug (e.g., the first plug 18) designed to be plugged into an airline power socket and another plug (e.g., the second plug 20) designed to be plugged into a cigarette lighter socket, distinct power outputs are desirable. Because airline power sources are designed with a power overload protection, it is desirable for the adapter 10 to limit the power that it draws when plugged into an airline socket (e.g., to a maximum power input of 75 watts in accordance with airline standards) while still drawing full power when plugged into a cigarette lighter socket.

To achieve distinct power outputs, a mechanism is required for determining which power source is providing the power. One way to accomplish this is to determine which plug is connected to a power source, as the plugs 18 and 20 are designed to plug into distinct types of power sources; thus, which plug is connected to a power source indicates which type of power source is being used. In the preferred embodiment described above, wherein the first plug 18 either attaches to a first power source, or attaches to the second plug 20 which further attaches to a second power source, determining which power source is being used depends on whether the first and second plugs 18 and 20 are fastened together. If the first plug 18 is not attached to the second plug 20, the adapter 10 is attached to the first power source (if any) because only the first plug 18 is exposed for connection to an associated power source. If the first plug 18 is attached to the second plug 20, the adapter 10 is attached to the second power source (if any) because the only the second plug 20 is exposed for connection to an associated power source.

Figure 5:
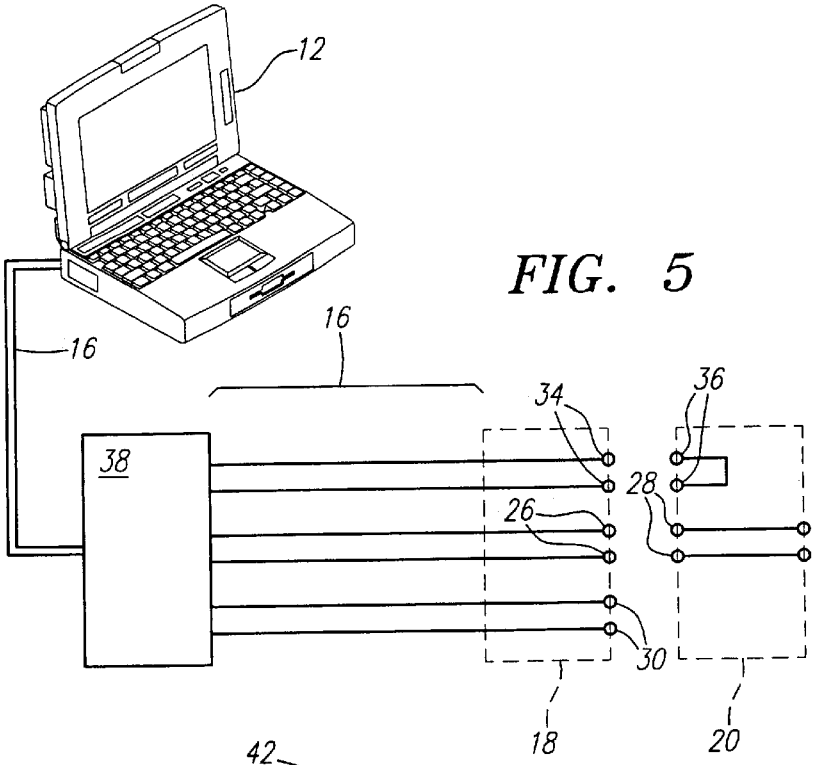
FIG. 5 is a schematic of the power adapter according to a preferred embodiment.
Figure 6:
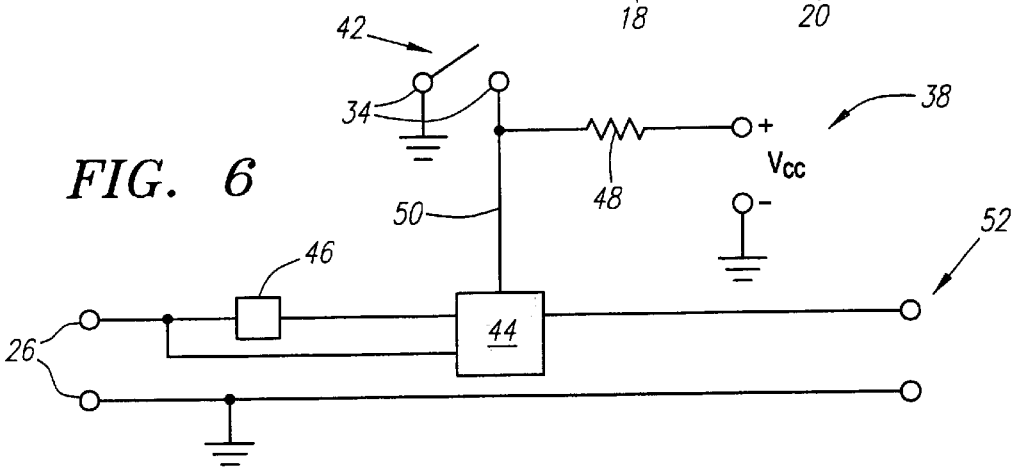
FIG. 6 is a schematic of an exemplary power control circuit according to a preferred embodiment.

A mechanism for determining which power source is attached to the adapter 10 is thus provided by a mechanism that determines whether the first and the second plugs 18 and 20 are mated together. Referring to FIGS. 4–6, a pair of conductors 34 are provided on the first plug 18. A third conductor 36 is aligned on the second plug 20 so as to mate with and electrically couple the pair of conductors 34. The pair of conductors 34 and the third conductor 36 form a switch 42, which is coupled to a power control circuit 38. When the first and second plugs 18 and 20 are attached, the switch 42 is closed; otherwise, the switch 42 is open.

The power control circuit 38 controls the electrical power output drawn from the power source and the power delivered to the device 12. The power control circuit 38 is coupled to the switch 42 (the pair of conductors 34) and the power leads 26 on the first plug 18. Physically, the power control circuit 38 is preferably located along the power cord 16, electrically coupled thereto and protected by a housing 40 as shown in FIG. 1. Because it is coupled to the pair of conductors 34, the power control circuit 38 can determine whether the first and second plugs 18 and 20 are attached (and thus which type of power source, if any, is being used) by testing whether the conductors 34 are open or short circuited.

Standard power control circuits use current or power limiters and comprise integrated circuits that monitor and limit current. Typical power control circuits monitor and limit power outputs according to predetermined criteria. For example, a typical power control circuit in a power adapter may monitor and prevent power surges from the power source to protect the device. As described, the adapter 10 provides distinct power output from distinct power sources. To achieve the distinct power outputs, the power control circuit 38 uses known techniques to limit or otherwise affect power output in response to the status of the pair of conductors 34 (open or closed circuit). In the auto-air adapter embodiment where the plugs are adapted to fit into an airline power socket and a cigarette lighter socket, it may be desired for the adapter 10 to limit the power output only when plugged into the airline power socket (e.g., to a maximum power input of 75 watts in accordance with airline standards) while drawing full power from the cigarette lighter socket. An exemplary implementation of such a power control circuit 38 is shown in FIG. 6. As explained, the pair of conductors 34 and the third conductor 36 form a switch 42 that indicates which power source is connected to the adapter 10. Electrical power from the power source is supplied to the power control circuit through power input leads 26, as described above, where one of the leads 26 is a grounded common element. A multiplexer 44 and standard power limiting circuitry 46 are provided. A power output from the power limiting circuitry 46 and a non-limited power output are inputted into the multiplexer 44.

An input control signal 50 is further inputted to the multiplexer 44, the input control signal 50 indicating whether the limited or non-limited power output is desired. The input control signal 50 is dictated by the status of the switch 42. One of the conductors 34 forming the switch 42 is grounded, and the other of the conductors 34 is coupled to a high voltage, $V_{CC}$, via a resistor 48. When the switch 42 is open, the input control signal 50 is high, at the $V_{CC}$ voltage. When the switch 42 is closed, the input control signal 50 is pulled down to ground, and is therefore at the low voltage. The multiplexer 44 can be thus controlled by the switch 42, selecting whether the power output is limited depending on the status thereof. The output 52 of the multiplexer 44 is the resulting limited or non-limited power output that is delivered to the electronic device 12.

It should be understood that the embodiment of the power control circuit 38 depicted in FIG. 6 is described by way of example only. Various power outputs can be provided depending on the desired power outputs for the various types of power sources for which the adapter 10 is designed.

While preferred embodiments and applications have been shown and described, as can be appreciated by those of ordinary skill in the art, the invention can be embodied in other specific forms without departing from the inventive concepts contained herein. The presently disclosed embodiments, therefore, should be considered as illustrative, not restrictive. Accordingly, the invention should not be limited except by the scope of the appended claims and their equivalents.

What is claimed is:

1. An electrical power adapter for providing power to a portable electronic device from multiple power sources, the power adapter comprising:

a power cord capable of electrically coupling to the electronic device and providing electrical power thereto;

a first plug electrically coupled to the power cord, the first plug adapted to be electrically coupled to a first power source;

a second plug having first and second ends, the first end adapted to be electrically coupled to the first plug, the second end adapted to be electrically coupled to a second power source;

a switch having first and second positions, wherein the switch is in the second position when the second plug is electrically coupled to the first plug, and the switch is in the first position otherwise; and a power control circuit electrically coupled to the switch, wherein the power control circuit controls the electrical power that the power adapter provides to the electronic device;

wherein the power adapter provides a first power output from the first power source to the electronic device when the switch is in the first position and a second power output from the second power source to the electronic device when the switch is in the second position, the first power output and the second power output being distinct.

2. The power adapter of claim 1, wherein the power control circuit limits the first power output to be substantially within a predetermined maximum.

3. The power adapter of claim 2, wherein the predetermined maximum is based on standards for the first power output.

4. The power adapter of claim 1, the switch comprising a pair of conductors electrically coupled to the power control circuit, wherein the conductors are electrically isolated when the switch is in the first position, and the conductors are electrically coupled when the switch is in the second position.

5. The power adapter of claim 4, further comprising a third conductor, wherein the pair of conductors are disposed on the first plug and the third conductor is disposed on the second plug, and further wherein when the switch is in the second position, the third conductor contacts and electrically couples the pair of conductors.

6. The power adapter of claim 1, wherein the first power source is an airline power socket.

7. The power adapter of claim 1, wherein the second power source is a cigarette lighter socket.

* * * * *